United States Patent [19]

Inoue

[11] Patent Number: 4,518,317

[45] Date of Patent: May 21, 1985

[54] FLUID PUMPING SYSTEM

[75] Inventor: Kiyoshi Inoue, Tokyo, Japan

[73] Assignee: Inoue-Japax Research Incorporated, Yokohama, Japan

[21] Appl. No.: 523,039

[22] Filed: Aug. 12, 1983

[30] Foreign Application Priority Data

Aug. 12, 1982 [JP] Japan ..... 57-140354

[51] Int. Cl.[3] ..... F04B 49/06; F04B 43/04; F04B 17/04; H02K 41/02

[52] U.S. Cl. ..... 417/45; 417/413; 417/417; 417/419; 310/12; 310/14

[58] Field of Search ..... 417/412, 413, 419, 418, 417/45, 44, 417, 416; 310/12, 14

[56] References Cited

U.S. PATENT DOCUMENTS

| | | | |
|---|---|---|---|
| 317,629 | 5/1885 | Conacher | 417/539 |
| 1,351,210 | 8/1920 | Heiliger | 417/412 |
| 1,654,859 | 1/1928 | Campbell . | |
| 2,003,647 | 6/1935 | Dillstrom | 310/14 |
| 2,954,917 | 10/1960 | Bayer | 417/418 X |
| 3,185,909 | 5/1965 | Jahn | 310/12 |
| 3,292,065 | 12/1966 | Fredrickson | 310/12 |
| 3,411,704 | 11/1968 | Hilgert et al. | 417/45 |
| 3,894,275 | 7/1975 | Baumans et al. | 310/12 X |
| 4,272,226 | 6/1981 | Osborne | 417/418 |
| 4,330,238 | 5/1982 | Hoffman | 417/45 X |

FOREIGN PATENT DOCUMENTS

| | | | |
|---|---|---|---|
| 382038 | 9/1923 | Fed. Rep. of Germany | 417/419 |
| 602152 | 3/1926 | France | 417/413 |
| 8536 | of 1901 | United Kingdom . | |
| 1192911 | 5/1970 | United Kingdom . | |

*Primary Examiner*—Carlton R. Croyle
*Assistant Examiner*—T. Olds
*Attorney, Agent, or Firm*—Karl F. Ross; Herbert Dubno

[57] ABSTRACT

A fluid pumping system including a variable-volume, fluid-reception chamber having an inlet conduit leading from a fluid supply site and an outlet conduit leading to a fluid delivery site. An elongated plunger body is drivingly coupled with the chamber and linearly reciprocable along its longitudinal axis so as to alternately expand and contract the volume of the chamber, thereby alternately drawing a fluid into the chamber through the inlet conduit from the fluid supply site and pumping the fluid through the outlet conduit towards the delivery site. The linear reciprocation of the plunger body is effected by an electromagnetically operated drive, preferably a linear motor drive, at a rate of reciprocation in the range of 0.01 to 10 Hz.

10 Claims, 1 Drawing Figure

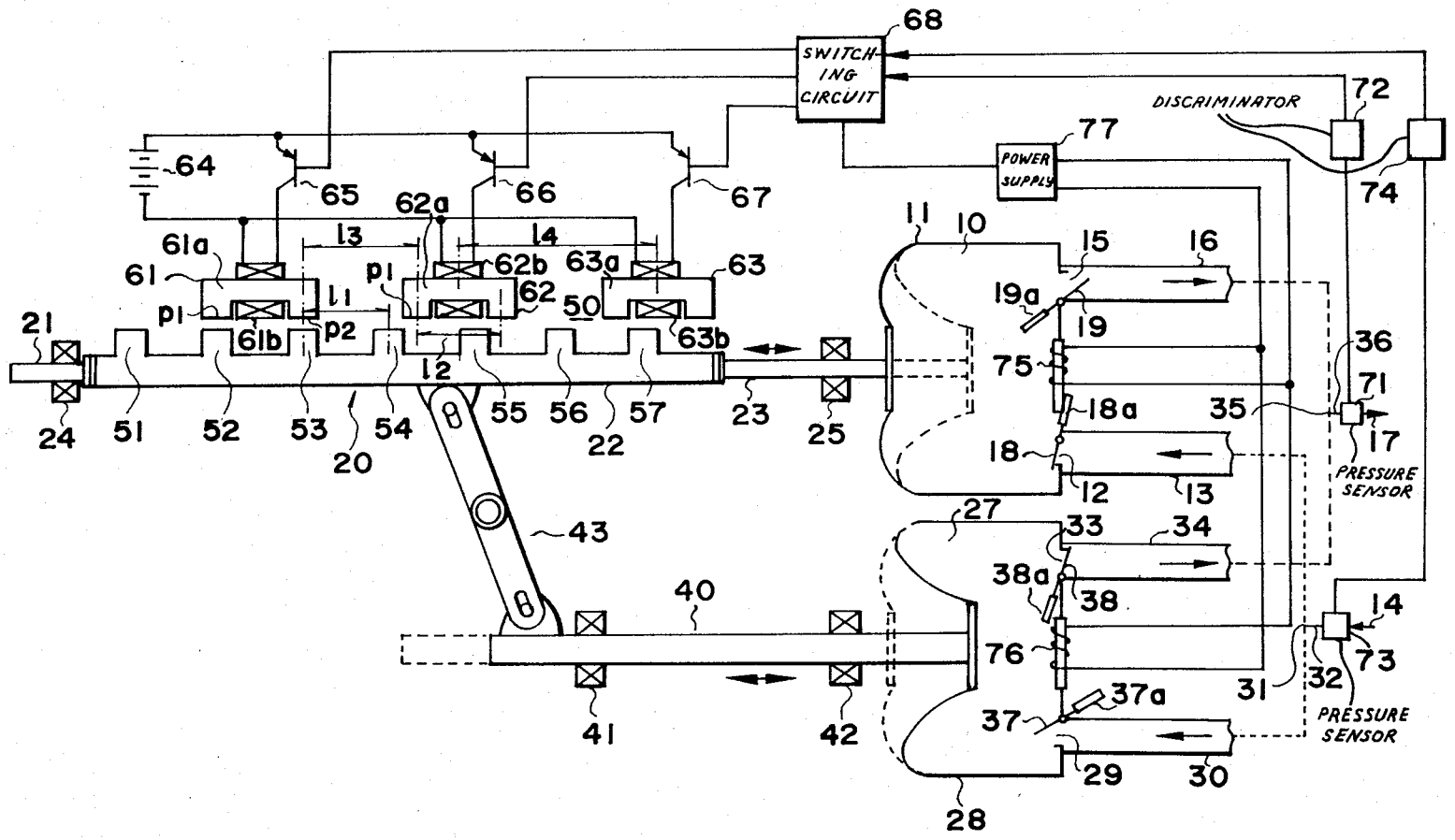
DISCRIMINATOR
POWER SUPPLY
SWITCHING CIRCUIT
PRESSURE SENSOR
PRESSURE SENSOR

FLUID PUMPING SYSTEM

FIELD OF THE INVENTION

The present invention relates to fluid pumping systems for various operating fluids such as liquids (e.g. water or oil) and gases (e.g. air) and more particularly—to a new and improved fluid pumping system designed on novel principles. The novel system herein disclosed may be used, among other purposes, for circulating water through an aquarium, or tank, pool or pond in which living aquatic animals or plants are kept, or for circulating air through such aquatic facilities, or for periodically or continuously pumping oxygen (air) in sewage treatment processes.

BACKGROUND OF THE INVENTION

While a variety of pumping systems for these and other purposes have hitherto been proposed and put into practical utility, it has been found that all of them are designed to operate on the pumping principles which require the pumping members to be driven at a relatively high rate of periodic displacement, e.g. rotation. As a result, it is quite common that the operations give rise to considerable noise. Most of the input electrical power is lost in sound, vibration, frictional resistance and heat. It has thus been observed that the power efficiency is as low as 5 to 10%.

OBJECT OF THE INVENTION

It is, accordingly, an object of the present invention to provide a fluid pumping system which obviates the conventional problems whereby a greater proportion of input power can be available for the actual pumping action and achievement.

SUMMARY OF THE INVENTION

According to the present invention there is provided a fluid pumping system which comprises a fluid-reception chamber having an inlet conduit leading from a fluid source site and an outlet conduit leading to a fluid delivery site; an elongate plunger means drivingly connected with the chamber and linearly reciprocable along its longitudinal axis so as to alternately expand and contract a volume of the chamber, thereby alternately drawing a fluid into the chamber through the inlet conduit from the source site and pumping the fluid through the outlet conduit towards the delivery site; and electromagnetically operated drive means for effecting the linear reciprocation of the plunger means at a rate of reciprocation in the range between 0.01 and 10 Hz.

The system may further comprise sensing means for monitoring the pressure of the input fluid in the inlet conduit, and control means responsive to the sensing means for controlling the drive means so as to maintain the pressure of the input fluid drawn into the said chamber substantially constant. The control means may be operative to halt the plunger means when the pressure exceeds a predetermined value.

Alternatively or in addition there may be provided sensing means for monitoring the pressure of the output fluid in the outlet conduit, and control means responsive to the sensing means for controlling the said drive means so as to maintain the pressure of the output fluid pumped out of the chamber substantially constant. The control means may be operative to halt the plunger means when the pressure exceeds a predetermined value.

Preferably, the system according to the invention further comprises: a second fluid-reception chamber having a second inlet conduit and a second outlet conduit, the second and the first-mentioned inlet conduits being interconnected at an inlet junction which leads from the said source site via a common inlet conduit, the second and the first-mentioned outlet conduits being interconnected at an outlet junction which leads to the delivery site via a common outlet conduit; and a second elongate plunger means drivingly connected with the second chamber and linearly reciprocable along its longitudinal axis so as to alternately expand and contract a volume of the second chamber, thereby alternately drawing the fluid therein through the second inlet conduit from the said source site and pumping the fluid through the second outlet conduit towards the said delivery site; the second plunger means being mechanically coupled with the first plunger means via linkage means so that when the first plunger means tends to expand the volume of the first chamber, the second plunger means acts to contract the volume of the second chamber and when the first plunger means tends to contract the volume of the first chamber, the second plunger means acts to expand the volume of the second chamber with the result that at substantially all times pumped output fluid in the common outlet conduit is fed to the delivery site and input fluid in the common inlet conduit is drawn from the source site.

The system may further comprise sensing means for monitoring the pressure of the input fluid in the said common inlet conduit, and control means responsive to the sensing means for controlling the said drive means so as to maintain the pressure of the input fluid drawn through the common inlet conduit substantially constant. The control means may be operative to halt the two plunger means when the pressure exceeds a predetermined value.

Alternatively or in addition there may be provided sensing means for monitoring the pressure of the input fluid in the common outlet conduit, and control means responsive to the sensing means for controlling the said drive means so as to maintain the output fluid pumped through the common outlet conduit substantially constant. The control means may be operative to halt the two plunger means when said pressure exceeds a predetermined value.

BRIEF DESCRIPTION OF THE DRAWING

These and other feature of the present invention as well as advantages thereof will become more readily apparent from the following description when taken with reference to the accompanying drawing in which the sole FIGURE is a schematic view diagrammatically illustrating a certain preferred embodiment of the fluid pumping system according to the present invention.

SPECIFIC DESCRIPTION

Referring now to the drawing, a fluid pumping system illustrated includes a variable-volume, fluid-reception chamber 10 which in the illustrated embodiment is defined inside of a flexible bag 11 composed of, e.g. a rubber of sufficient toughness. The bag 11 may be of bellows type. The chamber 10 has a fluid entrance part 12 connected via an inlet conduit 13 with a fluid supply site 14. The chamber 10 also has a fluid exhaust part 15 connected via an outlet conduit 16 with a fluid delivery site 17. The ports 12 and 15 are provided with valves 18 and 19 respectively. When the bag 11 tends to be expanded to increase the volume of the chamber 10, the entrance valve 18 is opened to draw a fluid from the supply site 14 into the chamber 10 and the exhaust valve 19 is closed to retain the fluid therein. When the bag 11 tends to contract to decrease the volume of the chamber 10, the entrance valve 18 is closed and the exhaust valve 19 is opened to force the fluid out of the chamber 10 towards the delivery site 17 via the outlet conduit 16.

The volume of the chamber 10 is alternately increased and decreased by means of a linearly reciprocating plunger means 20 operatively connected therewith. The means 20 is linearly elongated in its longitudinal axis and comprises linearly interconnected three parts 21, 22 and 23. One end plunger 23 is attached to the bag 11, and this and other end plungers 23 and 21 serve to journal the assembly 20 on a pair of bearing means 24 and 25 to allow the intermediate plunger 22 to be linearly reciprocated as an active output member in electromagnetically operated drive means (50) to be described.

The illustrated embodiment also includes a second variable-volume, fluid-reception chamber 27 which is again defined inside of a second flexible bag 28 which may be of specification identical to that of the first-mentioned flexible bag 11. The chamber 27 has a fluid entrance port 29 communicating via an inlet conduit 30 with the fluid supply site 14. Thus, the conduit 30 and the first-mentioned inlet conduit 13 are interconnected at an inlet junction 31 which is connected to the fluid supply site via a common inlet conduit 32. The chamber 27 also has a fluid exhaust port 33 communicating via an outlet conduit 34 with the fluid delivery site 17. Thus, here again, the conduit 34 and the first-mentioned outlet conduit 16 are interconnected at an outlet junction 35 which is connected to the fluid delivery site 17 via a common outlet conduit 36. The ports 29 and 33 are provided with valves 37 and 38, respectively. When the bag 28 tends to expand to increase the volume of the chamber 27, the entrance valve 37 is opened to draw the fluid from the supply site 14 into the chamber 27 and the exhaust valve 38 is closed to retain the fluid introduced therein. When the bag 28 tends to contract to decrease the volume of the chamber 27, the entrance valve 37 is closed and the exhaust valve 38 is opened to force the fluid out of the chamber 27 towards the delivery site 17.

The volume of the second chamber 27 is alternately increased and decreased by means of a second linearly reciprocating plunger means 40 attached to the bag 28 and which, journaled on bearing means 41 and 42, extends in parallel with the first-mentioned plunger means 20. The two plunger means are mechanically coupled by means of a linkage 43 so that when the first plunger means 20 is moved from right to left, the second plunger 40 is moved from left to right, and when the first plunger means is moved from left to right, the second plunger 40 is moved right to left. Consequently, in operation, when the first bag 11 is expanding to draw the fluid from the supply site 14 into the chamber 10 through its inlet conduit 13, the second bag 28 is always contracting to force the fluid out of the chamber 27 through its outlet conduit 34 towards the delivery site 17. When the first bag 11 is contracting to force the fluid out of the chamber 10 through its outlet conduit 16 to the delivery site 17, the second bag 28 is always expanding to draw the fluid into the chamber 27 through its inlet conduit 30 from the supply site 14. The result is that the delivery site 17 is always pumped with the fluid from either the the chamber 10 or the chamber 27.

The electromagnetically operated drive means referred to is constituted preferably by a linear motor arrangement as used in the illustrated embodiment. In this arrangement, the active plunger member 22 is composed of a magnetic material and is formed along its one lateral surface with a plurality of equi-distantly spaced magnetic teeth or projections 51–57 having an equal pitch L1 and arranged linearly. Disposed also linearly in juxtopposition with the toothed plunger member 22 are a plurality of equi-distantly spaced magnetic flux generators or electromagnets 61, 62, 63, have an identical configuration comprising a U-shaped core member 61*a*, 62*a*, 63*a* has a pair of poles p1 and p2 which are, in width, equal to each other and also to each tooth or projection on the plunger member 22. The distance L2 between the centers of poles p1 and p2 in each core member and hence in each electromagnet 61, 62, 63 is equal to the pitch length L1 of the teeth on the plunger member 22. The distance L3 between the centers of closer pole shoes p2 and p1 of adjacent electromagnets is here dimensioned to be equal to 4/3 L1. In addition, the distance L4 between the centers of the U-shaped core members of adjacent electromagnets is sized to be equal to 7/3 L1.

The coils 61*b*, 62*b*, 63*b* in the electromagnets shown are individually energized by a DC source 64 via switches 65, 66 and 67, respectively. The switches 65, 66 and 67 are successively switched on and off by a switching control circuit 68 to effect a pulsed energization of the coils 61*b*, 62*b* and 63*b* in succession.

In operation, assume that in the arrangement shown the switch 66 is first turned on to energize the coil 62*b*, thus magnetizing the core member 62*a*. The magnetic teeth or projections 54 and 55 will then tend to be attached to the magnetically activated pole shoes p1 and p2 of the core member 62*a*, thus causing the plunger member 22 and hence the entire plunger means 20 to bodily move to the right by a distance L1/3. Next, turn off the switch 66 and turn on the switch 67 to energize the coil 63*b*, thus magnetizing the core member 63*a*. This will cause the magnetic projections 56 and 57 to tend to be attracted to the pole shoes p1 and p2 of the core member 63*a*, thus causing the plunger member 20 to further move to the right again by a distance L1/3. With the switch 67 turned off, the switch 65 is next turned on to energize the coil 61*b*, thus magnetizing the core member 61*a*. This will cause the magnetic projections 51 and 52 to tend to be attracted to the pole shoes p1 and p2 of the core member 61*a*, thus causing the plunger means 20 to further move to the right again by a distance L1/3. In a series of these stepped operations it will be seen that the plunger means 20 is caused to linearly move from its predetermined left-hand end to its predetermined right-hand end to reduce the volume of the chamber 10 from a predetermined maximum extent to a predetermined minimum extent while increasing the volume of the chamber 27 from such a minimum extent to such a maximum extent.

It will be apparent that the reverse linear movement and hence the reverse volume chambers of the chambers 10 and 27 can be provided by switching on and off the coil-energizing switches in the order of 67, 66 and 65. A cyclic linear reciprocation of the plunger means 20 to draw the fluid from the supply site 14 and to pump the fluid into the delivery site is thus achieved. The rate of reciprocation of the plunger means 20 in terms of complete reciprocation cycles per second is set in the range of 0.01 to 10 Hz in the switching circuit 68.

A pressure sensor 71 is shown provided in the outlet conduit 36 for monitoring the pressure of the pumped outlet fluid to be fed to the delivery site 17 to provide a signal representing an instantaneous or average pressure level of the pumped output fluid. This signal is applied to a discriminator circuit 72 having a threshold level preset therein to correspond to a desired pressure level. When the sensed pressure level is ascertained to exceed or deviate from the preset pressure level, the discriminator circuit 72 acts to provide a control signal which is applied to the control circuit 68 to alter the rate of linear reciprocation of the plunger member i.e. the rate at which the coils are energized in succession so as to restore the pressure of the pumped output fluid at the preselected level.

A pressure sensor may alternatively or in addition be provided, as designated at 73, in the inlet conduit 32 for monitoring the pressure of the input fluid being drawn into the chamber 10, 27 from the supply site 14. The sensor 73 provides a signal representing an instantaneous or average pressure level of the drawn input fluid. The signal is applied to a discriminator 74 having a threshold valve preset to correspond to a desired input pressure level. When the sensed pressure level is ascertained to exceed or deviate from the preset pressure level, the discriminator 74 here again acts to provide a control signal which is applied to the switching circuit 68 to alter the rate of linear reciprocation of the plunger means 20 so as to return the pressure of the pumped output fluid to the preselected level.

The valves 18, 19, 37 and 38 are preferably of electromagnetic type. To this end, the valves 18 and 19: 37 and 38 have attached respectively thereto permanent magnets 18*a* and 19*a*; 37*a* and 38*a* and are respectively associated with solenoids 75; and 76. The solenoids 75 and 76 are energizable each with two alternating signals of opposite polarities furnished from a power supply 77 in response in two timing signals which are furnished from the switching control circuit 68. Thus, when the latter furnishes a first timing signal indicating that the plunger means 20 is switching the directions of its linear movement from leftward to rightward, the power supply 77 furnishes the solenoids 75 and 76 with a first energization signal of one polarity. The solenoid 75 is energized with this signal to magnetically attract the magnet 18*a*, thereby closing the entrance valve 18 and to magnetically repel the magnet 19*a*, thereby opening the exhaust valve 19, thus bringing the first chamber 10 into the pumping mode. The solenoid 76 is energized with the first energization signal to magnetically attract the magnet 38*a*, thereby closing the exhaust valve 38 and to magnetically repel the magnet 39*a*, thereby closing the entrance valve 39, thus bringing the second chamber 27 into the drawing mode. When the control circuit 68 furnishes a second timing signal indicating that the plunger means 20 is switching the directions of its linear movement from rightward to leftward, the power supply 77 furnishes the solenoids 75 and 76 with a second energization signal of the polarity opposite to that mentioned above. It will be seen that this signal brings the first chamber 10 into the drawing mode and the second chamber 27 into the pumping mode.

What is claimed is:

1. A fluid pumping system comprising:

a fluid-reception chamber having an inlet conduit leading from a fluid source site and an output conduit leading to a fluid delivery site;

an elongate plunger means drivingly connected with said chamber and linearly reciprocable along its longitudinal axis so as to alternately expand and contract a volume of said chamber, thereby alternately drawing a fluid therein through said inlet conduit from said source site and pumping the fluid through said outlet conduit towards said delivery site; and electromagnetically operated drive means for effecting said linear reciprocation of the plunger means at a rate of reciprocation in the range between 0.01 and 10 Hz, said electromagnetically operated drive means including:

an elongated member formed on said plunger means and comprised of magnetic material, said member being formed along one lateral surface with a plurality of equidistantly spaced magnetic teeth defining a row of such teeth, a plurality of magnetic flux generators disposed in a row opposite said row of teeth, each of said magnetic generators comprising a U-shaped core member having a pair of pole pieces confronting said row of teeth, the spacing between the pole pieces along said row of magnetic flux generators differing from the spacing of said teeth, and respective coils on each of said cores excitable electrically to generate respective magnetic fields at said cores, and a switching circuit connected to said coils for electrically exciting same in a predetermined sequence to displace said member in one and the opposite longitudinal direction.

2. A system as defined in claim 1, further comprising sensing means for monitoring the pressure of the input fluid in the inlet conduit, and control means responsive to said sensing means for controlling said drive means so as to maintain the pressure of the input fluid drawn into said chamber substantially constant.

3. The system defined in claim 2 wherein said control means is operative to halt said plunger means when said pressure exceeds a predetermined value.

4. A system as defined in claim 1, further comprising sensing means for monitoring the pressure of the output fluid in the outlet conduit, and control means responsive to said sensing means for controlling said drive means so as to maintain the pressure of the output fluid pumped out of said chamber substantially constant.

5. The system defined in claim 4 wherein said control means is operative to halt said plunger means when said pressure exceeds a predetermined value.

6. A system as defined in claim 1, further comprising:

a second fluid-reception chamber having a second inlet conduit and a second outlet conduit, said second and the first-mentioned inlet conduits being interconnected at an inlet junction which leads from said source site via a common inlet conduit, said second and the first-mentioned outlet conduits being interconnected at an outlet junction which leads to said delivery site via a common outlet conduit; and a second elongate plunger means drivingly connected with said second chamber and linearly reciprocable along its longitudinal axis so as to alternately expand and contract a volume of said second chamber, thereby alternately drawing the fluid therein through said second inlet conduit from said source site and pumping the fluid through said second outlet conduit towards said delivery site, said second plunger means being mechanically coupled with said first plunger means via linkage means so that when said first plunger means tends to expand the volume of said first chamber, said second plunger means acts to contract the volume of said second chamber and when said first plunger means tends to contract the volume of said first chamber, said second plunger means acts to expand the volume of said second chamber with the result that there are substantially at all times the pumped output fluid in the common outlet conduit to said delivery site and the drawn input fluid in the common inlet conduit from said source site.

7. A system as defined in claim 6, further comprising sensing means for monitoring the pressure of the input fluid in said common inlet conduit, and control means responsive to said sensing means for controlling said drive means so as to maintain the pressure of said input fluid drawn through said common inlet conduit substantially constant.

8. The system defined in claim 7 wherein said control means is operative to halt said two plunger means when said pressure exceeds a predetermined value.

9. A system as defined in claim 6, further comprising sensing means for monitoring the pressure of the outlet fluid in said common outlet conduit, and control means responsive to said sensing means for controlling said drive means so as to maintain said output fluid pumped through said common outlet conduit substantially constant.

10. The system defined in claim 9 wherein said control means is operative to halt said two plunger means when said pressure exceeds a predetermined value.

* * * * *